US007583561B2

(12) United States Patent
Liau et al.

(10) Patent No.: US 7,583,561 B2
(45) Date of Patent: Sep. 1, 2009

(54) FEED DETECTING SYSTEM

(75) Inventors: Wen-Bin Liau, Hsinchu (TW); Shih-Chung Shen, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 52 days.

(21) Appl. No.: 11/935,846

(22) Filed: Nov. 6, 2007

(65) Prior Publication Data

US 2009/0115126 A1 May 7, 2009

(51) Int. Cl.
*B65H 7/02* (2006.01)

(52) U.S. Cl. ..... 367/96

(58) Field of Classification Search ..... 367/96, 367/99, 100, 93, 98; 73/609; 271/265.01, 271/265.02, 265.03, 265.04, 3.15, 4.02, 4.03
See application file for complete search history.

(56) References Cited

U.S. PATENT DOCUMENTS

| | | | | |
|---|---|---|---|---|
| 7,172,195 | B2 | 2/2007 | Sano et al. | |
| 2008/0202243 | A1 * | 8/2008 | Gross | 73/627 |
| 2009/0115126 | A1 * | 5/2009 | Liau et al. | 271/265.01 |

* cited by examiner

*Primary Examiner*—Dan Pihulic
(74) *Attorney, Agent, or Firm*—WPAT, P.C.; Anthony King; Kay Yang

(57) ABSTRACT

A feed detecting system includes a sending element, a receiving element, a filtering-amplifying circuit, a peak-holding circuit, an A/D converter and a processing unit. The receiving element receives an ultrasonic signal sent by the sending element, and then outputs an electric signal, the filtering-amplifying circuit receives, filters and amplifies the electric signal, the A/D converter converts the electric signal to a digital signal, the processing unit reads the digital signal and compares the digital signal with a standard value stored in the processing unit. In this present invention, the A/D converter can be a low frequency A/D converter, so the cost of the feed detecting system is reduced.

2 Claims, 3 Drawing Sheets

FEED DETECTING SYSTEM

BACKGROUND OF THE INVENTION

1. Field of the Invention

This present invention relates to a sensor system, and more specifically to a feed detecting system for processing a feed detecting signal which is used in a scanner and a printer, etc.

2. The Related Art

Conventionally, a sheet-feeding apparatus is arranged in a scanner or a printer, for static electricity between papers or others reasons, two papers or more are fetched by the sheet-feeding apparatus in one time, the papers will block a paper passageway in the scanner or the printer, or a part of the paper will not be scanned or printed for being sheltered.

U.S. Pat. No. 7,172,195 has disclosed an image reading apparatus, the image reading apparatus comprises an ultrasonic wave sensor, the ultrasonic wave sensor includes a wave sending element and a wave receiving element having a same structure with the wave sending element. The wave receiving element and the wave sending element are arranged in the top and the bottom sides of the transport path of the image reading apparatus respectively. While a sheet passes through the image reading apparatus along the transport path, the wave sending element sends an ultrasonic signal to the sheet, the ultrasonic wave passes through the sheet, the ultrasonic wave is attenuated differently in case of one sheet and in case of two or more sheets. Then the ultrasonic wave is amplified, rectified and converted to digital signal, the digital signal is compared with a standard value stored in a control CPU, the standard value is indicated by the ultrasonic wave passing through a sheet. If the digital signal is greater than the standard value, no sheet passes through the transport path; if the digital signal is less than the standard value, two sheets or more pass through the transport path; if the digital signal equals with the standard value, one sheet passes through the transport path.

For converting the ultrasonic wave to a digital signal, an A/D converter is arranged in the image reading apparatus. In order to exactly detecting the ultrasonic wave, the A/D converter must be a high frequency A/D converter, the high frequency A/D converter is a high cost, so the cost of the image reading apparatus is improved.

SUMMARY OF THE INVENTION

An object of the invention is to provide a feed detecting system, the feed detecting system includes a sending element, a receiving element, a filtering-amplifying circuit, a peak-holding circuit, an A/D converter and a processing unit. The sending element is used to send an ultrasonic signal. The receiving element is used to receive the ultrasonic signal sent by the sending element, and the receiving element converts the ultrasonic signal to an electric signal. The filtering-amplifying circuit connects to the receiving element, and is used to receive, filter and amplify the electric signal, and then outputs the electric signal. The peak-holding circuit connects to the filter-amplifying circuit, and is used to receive the electric signal from the filtering-amplifying circuit, and hold a peak value of the electric signal for a span. The A/D converter connects to the peak-holding circuit, the A/D converter is used to receive and convert the peak value of the electric signal into a digital signal, then output the digital signal. The processing unit connects to the A/D converter, a standard value is stored in the processing unit, the processing unit reads the digital signal and compares the digital signal with the standard value. The standard value is a critical value between the ultrasonic wave from the sending element passing through one sheet and the ultrasonic wave passing through two sheets.

As above description, the peak-holding circuit receives the electric signal and holds the peak value of the electric signal for a span, the A/D converter may be a lower frequency A/D converter, but can satisfy the present feed detecting system, so the cost of the feed detecting system is reduced.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
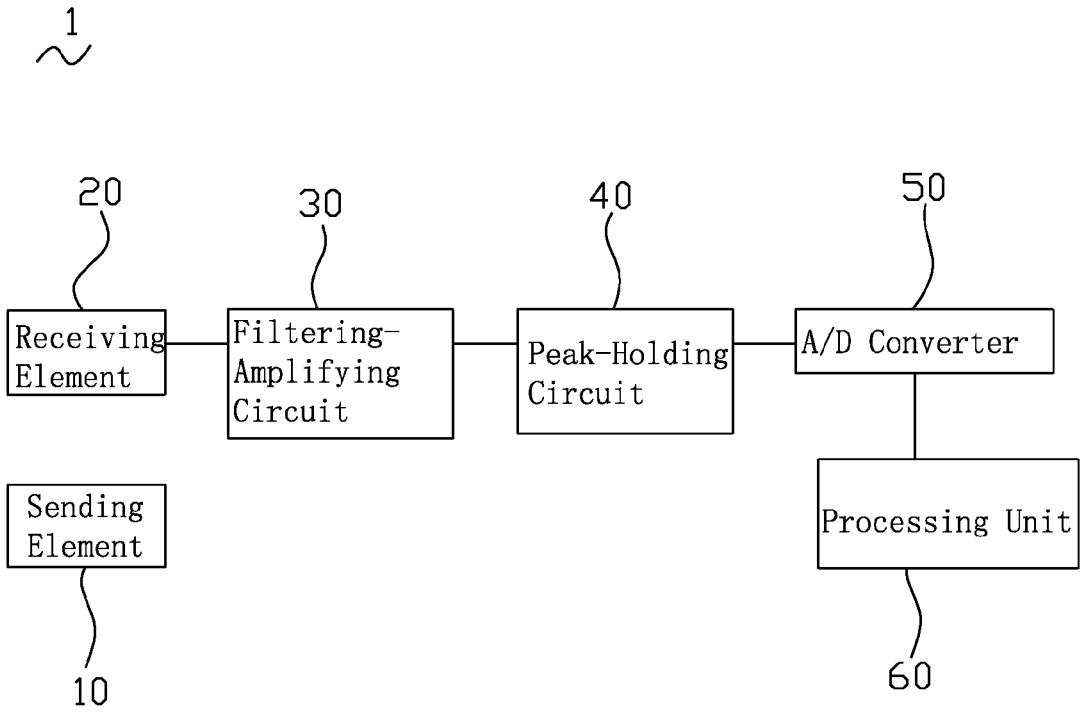
FIG. 1 is a block diagram showing a feed detecting system according to the present invention.

First referring to FIG. 1, a feed detecting system 1 according to the invention is shown. The feed detecting system 1 is arranged in a printer or a scanner, etc. The feed detecting system 1 includes a sending element 10, a receiving element 20, a filtering-amplifying circuit 30, a peak-holding circuit 40, an A/D converter 50 and a processing unit 60.

The sending element 10 is used to send an ultrasonic wave. The receiving element 20 is used to receiving the ultrasonic wave from the sending element 10, and converts the ultrasonic wave to an electric signal. The filtering-amplifying circuit 30 connects to the receiving element 20 for receiving the electric signal, then filtering and amplifying the electric signal. The peak-holding circuit 40 connects to the filtering-amplifying circuit 30 for receiving the electric signal from the filtering-amplifying circuit 30, the peak-holding circuit 40 holds a peak value of the electric signal for a span. The A/D converter 50 connects to the peak-holding circuit 40 for receiving the peak value of the electric signal from the peak-holding circuit 40 and converting the peak value of the electric signal to a digital signal. The processing unit 60 connects to the A/D converter 50 for receiving the digital signal from the A/D converter 50 and comparing the digital signal with a standard value stored in the processing unit 60, and then the processing unit 60 sends a resetting signal to eliminate the peak value in the peak-holding circuit 40.

The standard value is corresponding to a critical value between the ultrasonic wave from the sending element 10 passing through one sheet and the ultrasonic wave passing through two sheets. The processing unit 60 reads the digital signal from the A/D converter 50 and compares the digital signal with the standard value. If the digital signal is more than the standard value, the feed detecting system decides that no sheet passes through between the sending element 10 and the receiving element 20; if the digital signal is less than the standard value, the feed detecting system decides that two sheets or more pass through between the sending element 10 and the receiving element 20, the feed detecting system 1 sends a warning to the printer or the scanner; and if the digital signal nearly equals to the standard value, the feed detecting system decides that one sheet passes through between the sending element 10 and the receiving element 20, the sheet is processed unceasingly in the printer or the scanner.

Figure 2:
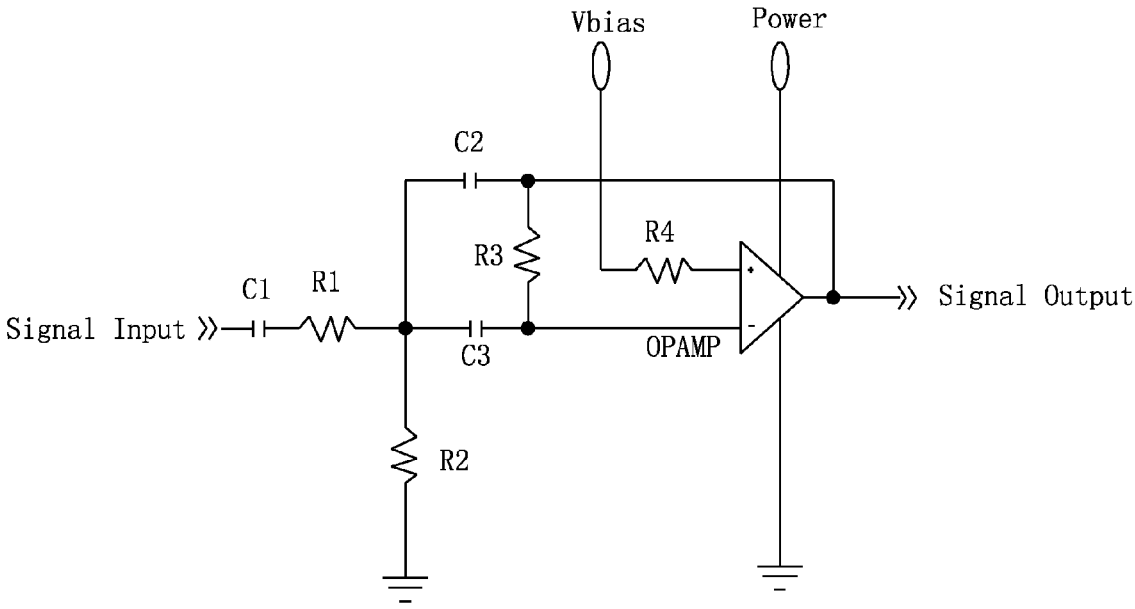
FIG. 2 is a circuit diagram of a filtering-amplifying circuit according to an embodiment of the present invention.

The filtering-amplifying circuit 30 showing in FIG. 2 is an embodiment. The filtering-amplifying circuit 30 includes three capacitances C1, C2 and C3, four resistances R1, R2, R3 and R4, and a first OPAMP (operational amplifier). A single electric source supplies the first OPAMP. The first capacitance C1, the first resistance R1 and the third capacitance C3 connect in series and connect to an anti-phase input point of the first OPAMP. A Vbias point connects to an in-phase input point of the first OPAMP via the fourth resistance R4. The second capacitance C2 and the second resistance R2 connect in series and connect a signal output point of the first OPAMP to GND. A connecting wire connecting the second capacitance C2 and the second resistance R2 connects to a connecting wire connecting the first resistance R1 and the third capacitance C3. The third resistance R3 connects the signal output point to the anti-phase input point. A signal input point delivers the signal from the receiving element 20 to the first capacitance C1. The signal is processed by the filtering-amplifying circuit 30 and then delivers to the peak-holding circuit 40.

Figure 3:
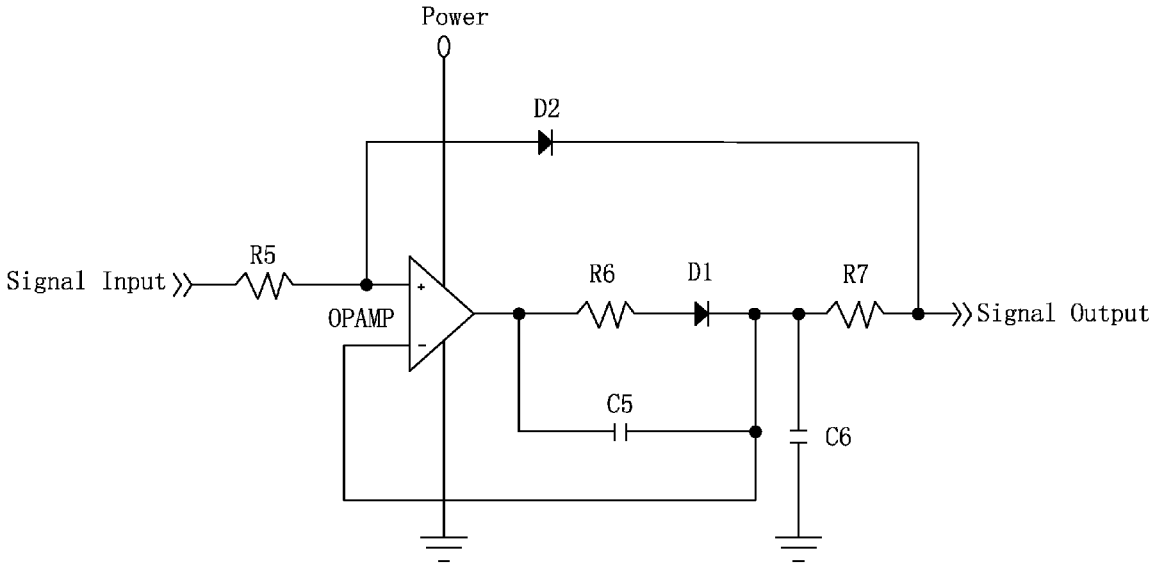
FIG. 3 is a circuit diagram of a peak-holding circuit according to an embodiment of the present invention.

The peak-holding circuit 40 in FIG. 3 is an embodiment. The peak-holding circuit 40 includes three resistances R5, R6 and R7, two diodes D1 and D2, two capacitances C5 and C6, and a second OPAMP. A single electric source supplies the second OPAMP. An input signal from the filtering-amplifying circuit 30 is delivered to an in-phase input point of the second OPAMP via the fifth resistance R5. The sixth resistance R6, the first diode D1 and the seventh resistance R7 connect in series and connect a signal output point of the second OPAMP. A signal processed by the peak-holding circuit 40 is output from the end of the seventh resistance R7. The second diode D2 connects the in-phase input point to the end of the seventh resistance R7. The fifth capacitance C5 parallel connects with the sixth resistance R6 and the first diode D1. The end of the first diode D1 connects to an anti-phase input point of the second OPAMP. The sixth capacitance C6 connects the end of the first diode D1 to GND. The second resistance R2 and the first diode D1 composes a half-wave recti-circuit to restore a high voltage in the second capacitance C2, then an MCU (microprocessor control unit) or an ASIC (application specific integrated circuit) reads the high voltage and then sends a resetting signal to eliminate the high voltage to provide next restoring.

As above description, the peak-holding circuit 40 receives the electric signal from the filtering-amplifying circuit 30 and holds the peak value of the electric signal for a span, so the A/D converter 50 may be a lower frequency A/D converter, but can process exactly the electric signal, therefore the cost of the feed detecting system 1 is reduced.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A feed detecting system, comprising:

a sending element used to send an ultrasonic signal;

a receiving element used to receive the ultrasonic signal sent by the sending element, the receiving element converting the ultrasonic signal to an electric signal;

a filtering-amplifying circuit connected to the receiving element, used to receive, filter and amplify the electric signal, and then output the electric signal;

a peak-holding circuit connected to the filter-amplifying circuit, used to receive the electric signal from the filtering-amplifying circuit and hold a peak value of the electric signal for a span;

an A/D converter connected to the peak-holding circuit, used to receive and convert the peak value of the electric signal into a digital signal, then output the digital signal;

a processing unit connected to the A/D converter, a standard value stored in the processing unit, the standard value corresponding to a critical value between the ultrasonic wave from the sending element passing through one sheet and the ultrasonic wave passing through two sheets, the processing unit reading the digital signal from the A/D converter and comparing the digital signal with the standard value; and wherein the filtering-amplifying circuit includes three capacitances, four resistances and a first OPAMP, a single electric source supplies the first OPAMP, the first capacitance, the first resistance and the third capacitance connect in series and connect to an anti-phase input point of the first OPAMP, a Vbias point connects to an in-phase input point of the first OPAMP via the fourth resistance, the second capacitance and the second resistance connect in series and connect a signal output point of the first OPAMP to GND, a connecting wire connecting the second capacitance and the second resistance connects to a connecting wire connecting the first resistance and the third capacitance, the third resistance connects the signal output point to the anti-phase input point, a signal input point delivers the signal from the receiving element to the first capacitance, the signal is processed by the filtering-amplifying circuit and then delivers to the peak-holding circuit.

2. The feed detecting system as set forth in claim 1, wherein the peak-holding circuit includes three resistances, two diodes, two capacitances and a second OPAMP, a single electric source supplies the second OPAMP, an input signal from the filtering-amplifying circuit is delivered to an in-phase input point of the second OPAMP via the fifth resistance, the sixth resistance, the first diode and the seventh resistance connect in series and connect a signal output point of the second OPAMP, a signal processed by the peak-holding circuit is output from the end of the seventh resistance, the second diode connects the in-phase input point to the end of the seventh resistance, the fifth capacitance parallel connects with the sixth resistance and the first diode, the end of the first diode connects to an anti-phase input point of the second OPAMP, the sixth capacitance connects the end of the first diode to GND, the second resistance and the first diode composes a half-wave recti-circuit to restore a high voltage in the second capacitance.

* * * * *